US005257906A

United States Patent [19]

Gray et al.

[11] Patent Number: 5,257,906

[45] Date of Patent: Nov. 2, 1993

[54] EXHAUST SYSTEM FOR A TURBOMACHINE

[75] Inventors: Lewis Gray, Winter Springs; Douglas C. Hofer; Susan M. Kron, both of Orlando; Robert C. Wynn, Winter Springs, all of Fla.

[73] Assignee: Westinghouse Electric Corp., Pittsburgh, Pa.

[21] Appl. No.: 906,343

[22] Filed: Jun. 30, 1992

[51] Int. Cl.[5] ..... F01D 25/30

[52] U.S. Cl. ..... 415/226; 415/225; 415/211.2

[58] Field of Search ..... 415/208.2, 211.2, 220, 415/224.5, 225, 226

[56] References Cited

U.S. PATENT DOCUMENTS

| | | | |
|---|---|---|---|
| 3,058,720 | 10/1962 | Hart et al. | 253/76 |
| 3,149,470 | 9/1964 | Herzog | 60/64 |
| 3,690,786 | 9/1972 | Silvestri, Jr. | 415/121 |
| 3,697,191 | 10/1972 | Heymann | 415/168 |
| 3,945,760 | 3/1976 | Miller | 415/189 |
| 4,390,319 | 6/1983 | Garkusha et al. | 415/211.2 |
| 4,391,566 | 7/1983 | Takamura | 415/209 |
| 4,863,341 | 9/1989 | Groenendaal | 415/103 |

FOREIGN PATENT DOCUMENTS

418887A1 3/1991 European Pat. Off. .

*Primary Examiner*—Edward K. Look
*Assistant Examiner*—Michael S. Lee

[57] ABSTRACT

An exhaust system for an axial flow turbomachine is provided having a diffuser that directs the flow of working fluid from a turbine exit to an exhaust housing having a bottom opening, thereby turning the flow 90° from the axial to radial direction. In the exhaust housing, the flow exiting at the top of the diffuser turns 180° from the vertically upward direction to the downward direction. The strength of the vortex formed in the exhaust housing as a result of this turning is minimized by orienting the outlet of an outer exhaust flow guide portion of the diffuser so that it lies in a plane that makes an angle with a plane perpendicular to the turbine axis. As a result, the minimum axial length of the outer flow guide occurs at a location remote from the exhaust housing outlet and the maximum axial length occurs at a location proximate the opening, thereby crowding the vortex against a radially extending baffle in the exhaust housing.

19 Claims, 4 Drawing Sheets

EXHAUST SYSTEM FOR A TURBOMACHINE

BACKGROUND OF THE INVENTION

The present invention relates to an exhaust system for a turbomachine, such as a steam or gas turbine or the like. More specifically, the present invention relates to an exhaust system for an axial flow turbomachine that minimizes the strength of harmful vortices within the flow.

The performance of a steam turbine may generally be improved by lowering the back pressure to which the last row of blades of the turbine is subjected. Consequently, turbines often discharge to a condenser in which a sub-atmospheric pressure is maintained. Typically, the exhaust steam discharging axially from the last row of blades is directed to a condenser mounted below the turbine by turning the flow 90° from the axial to the vertically downward directions. This turning of the flow is accomplished by an exhaust system that includes a diffuser in flow communication with an exhaust housing.

Diffusers are generally comprised of inner and outer flow guides that serve to increase the static pressure by reducing the velocity head. Typically, the cross-sectional shape of the outer flow guide is a simple arcuate shape—see, for example, U.S. Pat. Nos. 3,945,760; 4,863,341; 3,058,720; 3,697,191; and 3,690,786. However, conical shaped diffusers have also been utilized—see, for example, U.S. Pat. No. 4,391,566. Although outer flow guides are generally of uniform axial length, at least one steam turbine manufacturer has utilized an outer flow guide in a bottom exhaust system that has an axial length that varies around its circumference, being a maximum at the bottom of the diffuser and a minimum at the top.

The exhaust housing receives steam from the diffuser and directs it to the condenser through a bottom outlet opening in the housing. To obtain maximum performance, it is important to configure the exhaust system so as to minimize losses arising from the formation of vortices in the steam flow. However, as explained below, the difficulty of this task is exacerbated by the somewhat torturous path the steam must take as it is directed to the condenser.

The steam from the diffuser enters the exhaust housing in a 360° arc. However, it discharges from the exhaust housing to the condenser through only the bottom outlet opening. This presents no problem with respect to the steam flowing in the bottom portion of the diffuser since by turning such steam into the radial direction, the diffuser turns the steam directly toward the bottom outlet opening. However, the steam discharging at the top of the diffuser must turn 180° from the vertically upward direction to the vertically downward direction, in addition to turning 90° from the axial direction to the vertically upward direction. Consequently, vortices are formed within the exhaust housing in the vicinity of the top of the diffuser outlet that create losses in the steam flow that detract from the efficiency of the exhaust system and, therefore, the performance of the turbine.

One approach for minimizing such losses used in the past involves the incorporation of flow dividers into the exhaust diffuser that allow the steam to expand and turn into the radial direction through several smaller concentric flow passages, rather than a single large flow passage, as disclosed in U.S. Pat. No. 3,149,470 (Herzog). Another approach, suggested for a gas turbine exhaust system, involves the use of flow stabilizing ribs formed on the outer diameter of the diffuser that guide the flow toward the outlet opening so as to prevent the formation of vortices, as disclosed in U.S. Pat. No. 4,391,566 (Takamura). However, such approaches have not been entirely successful and can result in a considerable increase in the manufacturing cost of the diffuser.

It is therefore desirable to provide an exhaust system for a turbomachine capable of turning an axial flow discharging from the turbine into a radial direction, such as vertically downward, in such a way that the formation of vortices and other loss mechanisms are minimized. It is also desirable that the shape of the exhaust diffuser in such an exhaust system facilitate its manufacture, thereby minimizing the cost of the diffuser.

SUMMARY OF THE INVENTION

Accordingly, it is the general object of the current invention to provide an exhaust system for a turbomachine capable of turning an axial flow discharging from the turbine into a direction perpendicular to the axial direction, such as vertically downward, in such a way that the formation of vortices and other loss mechanisms are minimized.

Briefly, this object, as well as other objects of the current invention, is accomplished in a turbomachine comprising (i) a turbine cylinder forming a flow path for a working fluid, (ii) an exhaust conduit for directing the working fluid away from the turbine cylinder, and (iii) an exhaust diffuser for directing the flow of the working fluid from the turbine cylinder to the exhaust conduit. According to the current invention, the exhaust diffuser has (i) an inner flow guide, (ii) an outer flow guide having an outlet defining an axial length of the outer flow guide, the axial length varying around the periphery of the flow guide and being a minimum at a predetermined location on the periphery, and (iii) a substantially radially extending member disposed axially a predetermined distance from the outlet at the predetermined location.

In one embodiment of the current invention, the cylinder discharges the working fluid in a substantially axial direction and the flow path formed by the exhaust conduit discharges the working fluid in a direction substantially perpendicular to the axial direction. The exhaust diffuser turns the direction of flow of the working fluid approximately 90°. The exhaust conduit has an inlet in which the outer flow guide outlet is disposed and an outlet formed in only a portion of its periphery, whereby in a first portion of the outer flow guide its outlet is proximate the exhaust conduit outlet and in a second portion of the outer flow guide its outlet is remote from the exhaust conduit outlet. The axial length of the outer flow guide varies around its periphery, the axial length of the outer flow guide being at a maximum value in its first portion and a minimum value in its second portion.

DESCRIPTION OF THE PREFERRED EMBODIMENT

Figure 1:
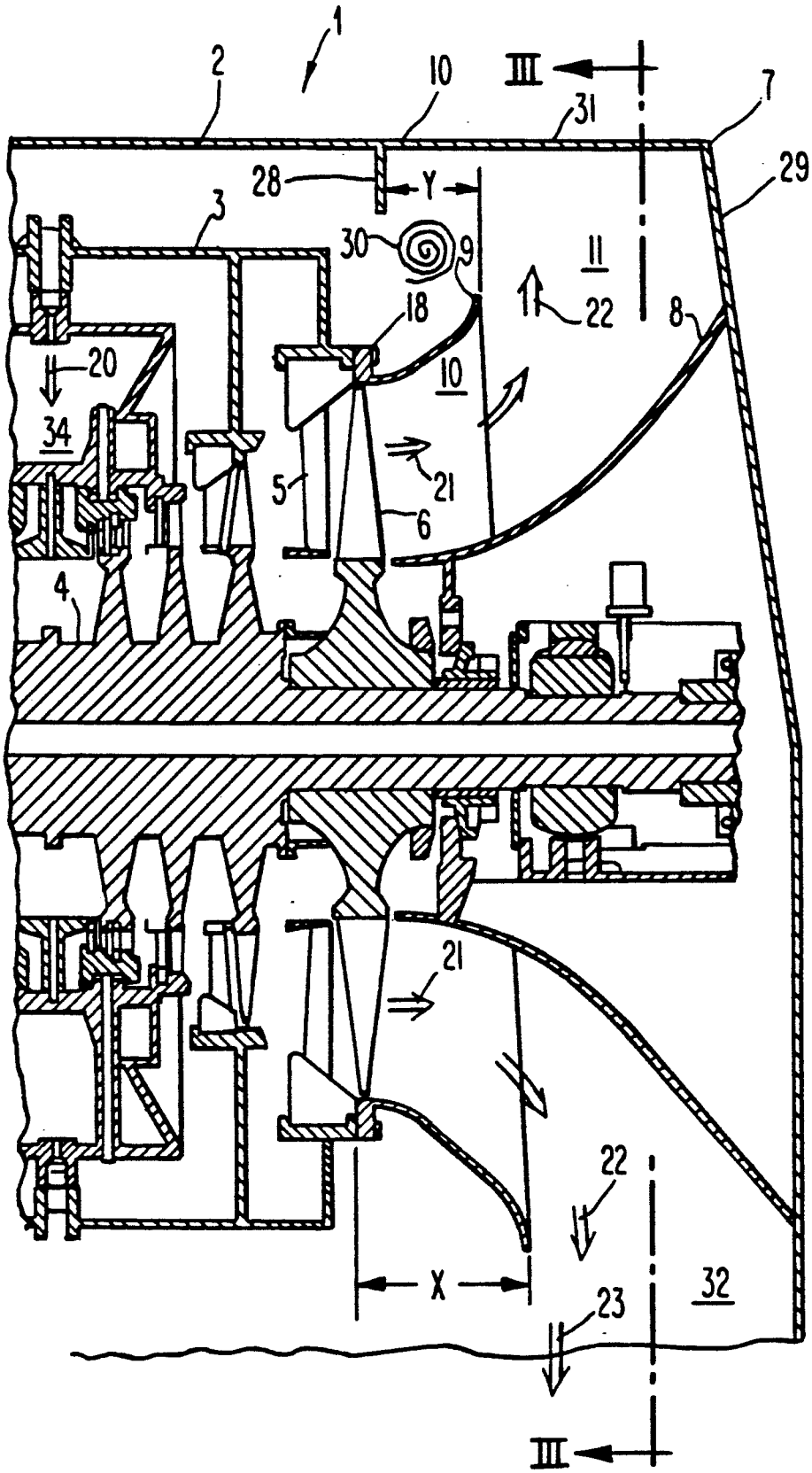
FIG. 1 is a longitudinal cross-section through a portion of a low pressure steam turbine incorporating the exhaust system according to the current invention.
Figure 2:
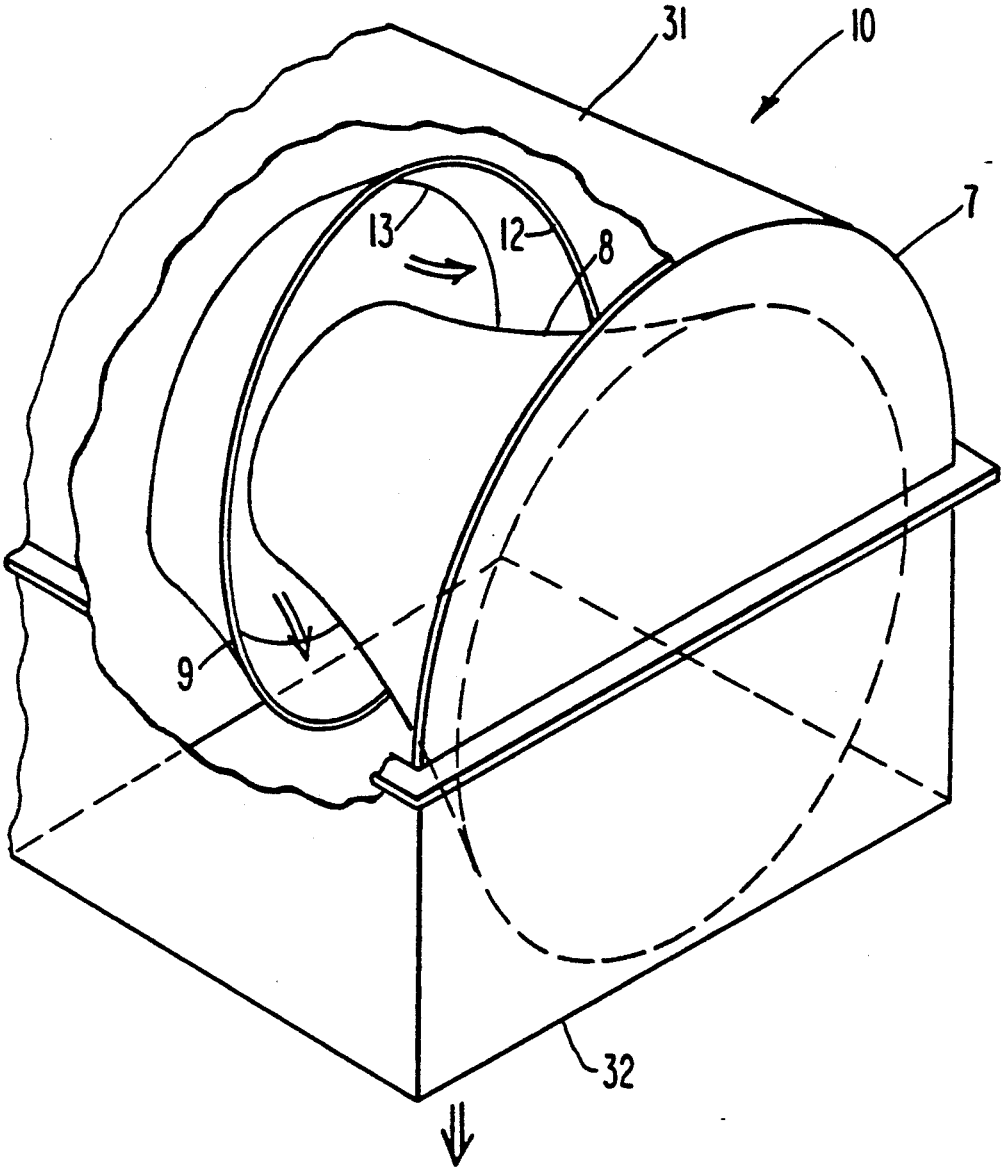
FIG. 2 is an isometric view of the exhaust system shown in FIG. 1.

There is shown in FIG. 1 a longitudinal cross-section of the right half of a low pressure steam turbine 1 with a downward exhaust. The primary components of the steam turbine are an outer cylinder 2, an inner cylinder 3 enclosed by the outer cylinder, a centrally disposed rotor 4 enclosed by the inner cylinder and an exhaust system 10. The inner cylinder 3 and rotor 4 form an annular steam flow path therebetween, the inner cylinder forming the outer periphery of the flow path. A plurality of stationary vanes 5 and rotating blades, each of which has an airfoil portion, are arranged in alternating rows and extend into the steam flow path. The vanes 5 are affixed to the inner cylinder 3 and the blades are affixed to the periphery of the rotor 4.

As shown in FIGS. I and 2, the exhaust system 10 is comprised of an exhaust housing 7 formed by an end wall 29 connected to a horseshoe-shaped rim 31. An outlet 32 is formed in the bottom of the exhaust housing 7 and is connected to a condenser (not shown). An exhaust diffuser is disposed within the exhaust housing 7. The exhaust diffuser is formed by inner and outer approximately frusto-conical members 8 and 9, respectively, referred to as flow guides. The inner and outer flow guides 8 and 9 form a substantially annular diffusing passage therebetween. The airfoil portions 6 of the blades in the last row of blades—that is, the in the row that is farthest downstream—are disposed just upstream of the outer flow guide 9. The outer flow guide 9 is attached via a flange 18 to the inner cylinder 3.

Figure 3:
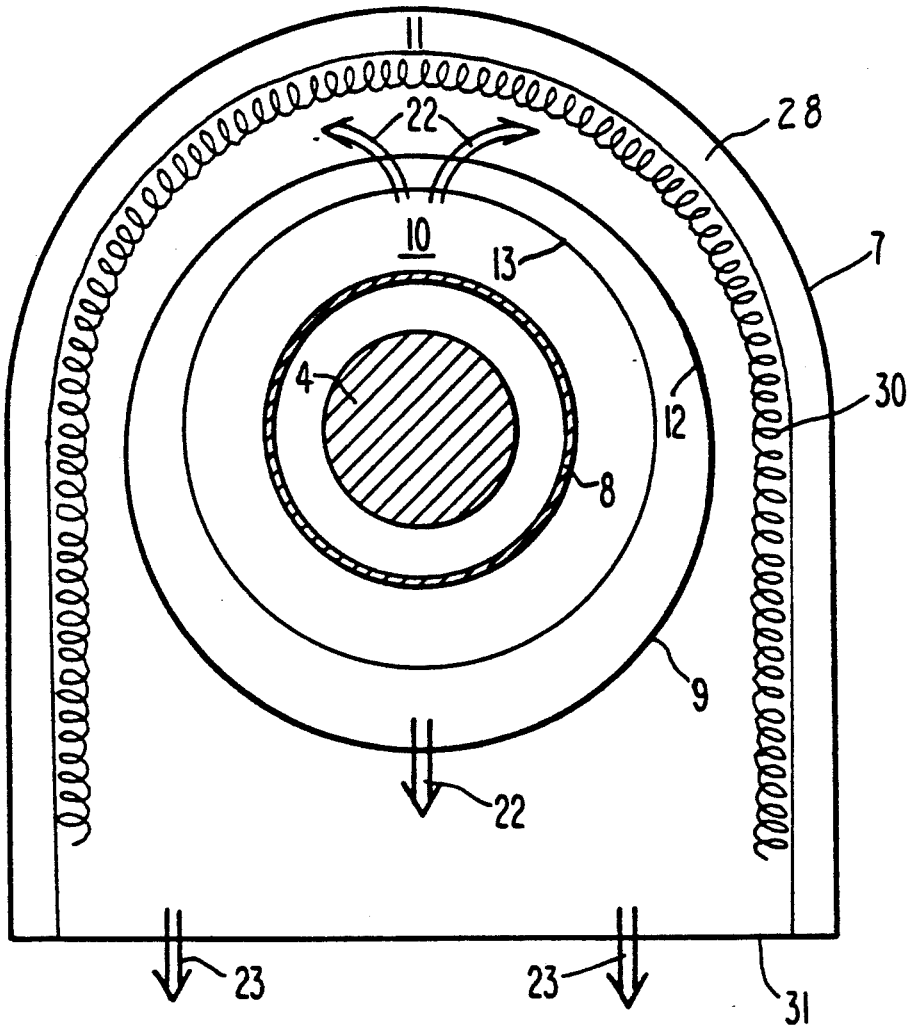
FIG. 3 is a cross-section taken through line III—III shown in FIG. 1.

As shown in FIG. 3, the exhaust housing 7 forms the outer boundary for an approximately horseshoe-shaped chamber 11. The inner boundary of the chamber 11 is formed by the outer flow guide 9.

As shown in FIG. 1, steam 20 enters the steam turbine 1 from an annular chamber 34 in the outer cylinder 2. The steam flow is then split into two streams, each flowing axially outward from the center of the steam turbine through the aforementioned steam flow path, thereby imparting energy to the rotating blades. The steam 21 discharges axially from the last row of blades 6 and enters the exhaust diffuser. The exhaust diffuser guides the steam 21 into the exhaust housing 7 over a 360° arc. Due to the curvature of its inner surfaces, the diffuser turns the steam 21 approximately 90° into a substantially radial flow of steam 22 entering the chamber 11. The chamber 11 directs the steam 22 to the exhaust housing outlet 32.

As shown in FIG. 3, at the bottom of the chamber 11 the radially flowing steam 22 exiting the diffuser merely continues to flow radially downward through the outlet 32. However, at the top of the chamber 11—that is, at the apex of the horseshoe shape—the steam 22 is discharged in the vertically upward direction by the exhaust diffuser and must turn an additional 180° around the horseshoe-shape to flow vertically downward through the opening 32. As a result of these large and relatively abrupt changes in steam flow direction, a vortex 30 is formed in the steam flow within the chamber just behind the outlet 12 of the outer flow guide 9. As shown in FIG. 3, the vortex 30 extends around the chamber 11 in a horseshoe-shape and increases the aerodynamic losses of the exhaust system 10, thereby detracting from the turbine performance.

Figure 4:
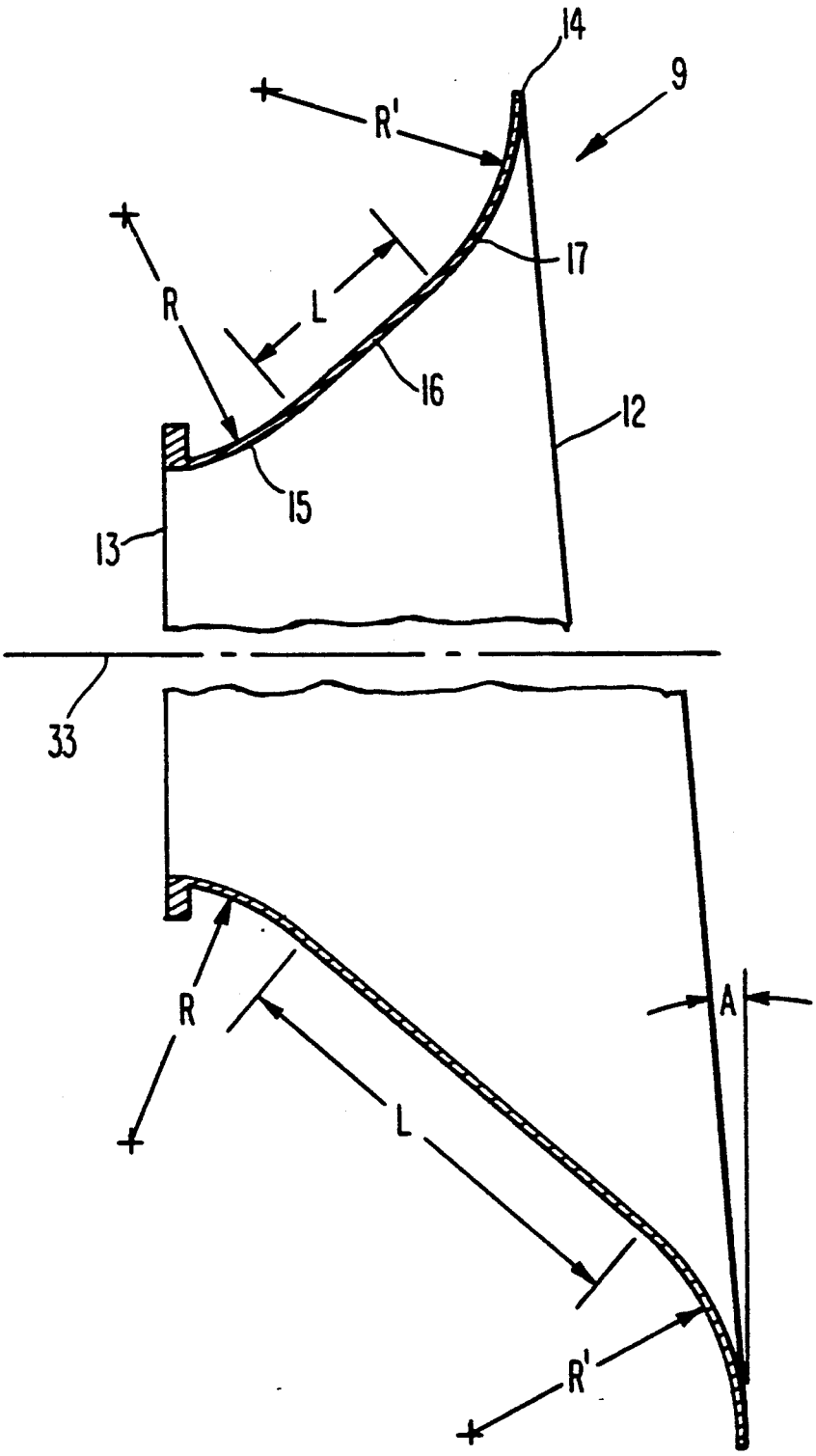
FIG. 4 is a longitudinal cross-section of a preferred shape of the outer flow guide according to the current invention.

According to the current invention, the strength of this vortex and, therefore, its ability to affect the losses, is minimized by the novel exhaust system of the current invention. Specifically, as shown in FIG. 4, although the flow guide inlet 13 lies in a plane that is oriented perpendicularly to the axis 33 of the turbine, the outlet 12 lies in a plane that is oriented at an angle A to a plane perpendicular to the turbine axis. In the preferred embodiment, the angle A is approximately 3°. The plane in which the flow guide outlet 12 lies has been rotated counter clockwise, when viewed as in FIG. 1, from the perpendicular about a horizontal axis so that the top of the outlet is disposed upstream of the bottom of the outlet. As a result, the axial length X of the outer flow guide 9, shown in FIG. 1, varies linearly around its circumference and is at a minimum value at the top of the flow guide, remote from the exhaust housing outlet 32, and is at a maximum value at the bottom of the flow guide, proximate the exhaust housing outlet 32.

As shown in FIG. 1, a baffle 28, affixed to the top of the housing 7, extends radially inward into the chamber 11 at its apex. According to the current invention, the aforementioned variation in the outer flow guide 9 axial length, together with the baffle 28, ameliorates the effect of the vortex 30. Specifically, because of the shortened length of the outer flow guide 9 at its top, the steam flow 21 exits at the top of the diffuser closer to the baffle 28 than it otherwise would, as shown in FIG. 1. As a result, the vortex 30 is somewhat "crowded" against the baffle 28. This "crowding" of the vortex 30 has the salutary effect of reducing its strength. The desired distance Y, shown in FIG. 1, from the outlet 12 of the outer flow guide 9 to the baffle 28 at the top of the diffuser to ensure sufficient "crowding" of the vortex is a function of the length of the airfoil 6 of the blades in the last row of rotating blades. In the embodiment shown in FIG. 1, the length of the airfoil portions 6 of the last row of blades is approximately 119 cm (47 inches). Note that the outer flow guide 9 shape and the baffle 28 allows the vortex to be crowded without excessive shortening of the outer flow guide.

Figure 5:
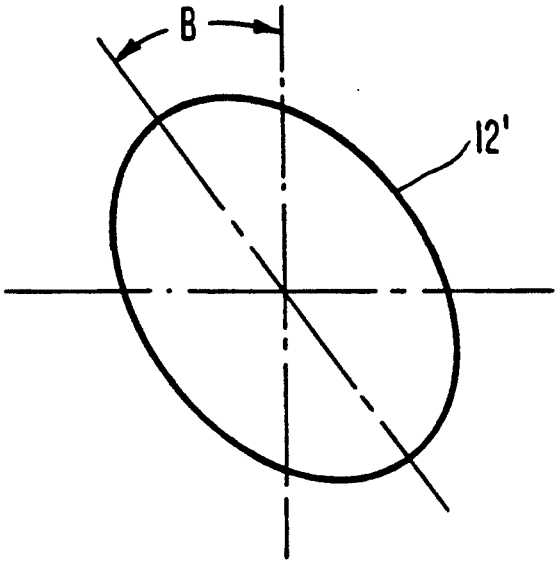
FIG. 5 is a view similar to FIG. 3 showing the shape of the outlet of the outer flow guide according to an alternate embodiment of the current invention projected onto a plane normal to the turbine axis.

In the embodiment of the invention discussed above, the minimum axial length of the outer flow guide 9 is at top dead center and the maximum axial length is at bottom dead bottom center. Thus, the flow guide outlet 12 can be considered as having been rotated about a horizontal axis so that it maintains its symmetry about a vertical axis—that is, if the circular outlet 12 were projected onto a vertical plane—for example, as viewed in FIG. 3—it appear as an ellipse having a major axis that is horizontally oriented and a minor axis that is vertically oriented. However, in some turbine designs, the amount of swirl in the steam flow 21 exiting the last row turbine blades will make it advantageous to skew the outlet 12 so that minimum and maximum axial lengths are rotated off of top and bottom dead center. As a result the flow guide outlet 12' will no longer be symmetric about the vertical axis and, when projected in a vertical plane, the major and minor axes will be rotated by an angle B with respect to the horizontal and vertical directions, as shown in FIG. 5.

According to an important aspect of the current invention, the outer flow guide 9 is shaped so that the flow guiding inner surface adjacent its outlet edge 14 is oriented substantially radially, as shown in FIG. 4. As a result, the flow guide fully turns .the steam flow into the radial direction. Using the flow guide to fully turn the steam flow from the axial to the radial direction, has the salutary effect of reducing the aerodynamic losses in the diffuser.

Unfortunately, combining this complete radial turning feature with the aforementioned varying axial length feature considerably complicates the manufacture of the outer flow guide if the simple arcuate cross-sectional shape heretofore used in the art were retained. This is so because with a simple arcuate shape, the cross-sectional radius of curvature of outer flow guide would have to vary continuously around its circumference in order to maintain the orientation of the inner surface adjacent the outlet edge 14 in the radial direction over the full 360° arc of the outer flow guide outlet 12. If the radial orientation of this inner surface were not maintained, the aforementioned benefit of using the outer flow guide to fully turn the flow would be compromised. However, varying the radius of curvature around the circumference so as to maintain the radial orientation of the inner surface adjacent the outlet edge 14 would require a complex and expensive die for forming the flow guide if a simple arcuate shaped cross-section were used.

According to the current invention, this manufacturing problem is overcome, without sacrificing performance, by utilizing the novel outer flow guide shape shown in FIG. 4. Specifically, the shape of the outer flow guide 9 is characterized by a compound conical-/arcuate shape—that is, a straight conical section 16 is utilized to connect inlet and outlet arcuate sections 15 and 17, respectively.

As shown in FIG. 4, the inlet arcuate section 15 is symmetrical about the turbine axis 33 so that its radius of curvature R′ remains constant around the circumference of the outer flow guide 9. The outlet arcuate section 17 is also symmetric except that its axis of symmetry has been tilted at the aforementioned angle A. In addition, its radius of curvature R′ is also constant around the circumference of the flow guide. In the preferred embodiment, R is approximately equal to R′. The outlet 12 of the flow guide has been oriented at angle A by varying the length L of the conical section 16.

The novel shape of the flow guide shown in FIG. 4 considerably simplifies its manufacture because, although the axial length of the flow guide varies constantly about its circumference and the orientation of the inner surface adjacent the outlet edge 14 remains substantially radial around the entire circumference, the radii of curvature of the three sections 15, 16 and 17 from which the flow guide is formed each have a constant radius of curvature. Accordingly, the need for a complex shaped die has been eliminated. Moreover, since both the inlet section 15 and the outlet section 17 have the same radius of curvature, only a single die is required.

In addition to the radial orientation of the outlet edge 14, the specific shape of the outer flow guide 9 shown in FIG. 4 has been chosen to provide optimum performance of the diffuser. According to the current invention, the optimum radii of curvature R and R′ of the inlet and outlet arcuate sections 15 and 17, respectively, and the optimum length L of the straight section 16 are a function of the length of the airfoils 6 of the blades in last row of the turbine. Specifically, it has been found that the ratio of the radii of curvatures R and R′ to the blade airfoil length should be in the range of approximately 0.25 to 0.4, optimally approximately 0.32. In addition, the ratio of the length L of the straight section 16 at top dead center to the airfoil length should be in the range of approximately 0.075 to 0.095, optimally, approximately 0.085. The length of the straight section should increase uniformly from top dead center to bottom dead center, so that the ratio of the length of the straight section 16 at bottom dead center should be in the range of approximately 0.34 to 0.42, optimally, approximately 0.38.

Although the current invention has been described with reference to a bottom exhaust low pressure steam turbine, the invention is equally applicable to side or top exhaust steam turbines by tilting the plane of the outer diffuser outlet 12 so that the axial length of the flow guide is at a minimum value in the portion of the flow guide remote from the exhaust outlet and at a maximum value at the portion proximate the exhaust outlet. In addition, the invention is equally applicable to other axial flow devices, such as gas turbines, fans and compressors. Accordingly, the present invention may be embodied in other specific forms without departing from the spirit or essential attributes thereof and, accordingly, reference should be made to the appended claims, rather than to the foregoing specification, as indicating the scope of the invention.

What is claimed is:

1. A turbomachine, comprising:

a) a turbine cylinder forming a flow path for a working fluid;

b) an exhaust conduit for directing said working fluid away from said turbine cylinder;

c) an exhaust diffuser for directing the flow of said working fluid from said turbine cylinder to said exhaust conduit, said exhaust diffuser having (i) an inner flow guide, (ii) an outer flow guide having an outlet defining an axial length of said outer flow guide, said axial length varying around the periphery of said flow guide and being a minimum at a predetermined location on said periphery, and (iii) a substantially radially extending baffle disposed axially a predetermined distance from said outlet at said predetermined location.

2. The turbomachine according to claim 1, outer flow guide has a compound conical/arcuate shape comprised of substantially arcuate inlet and outlet sections connected by a substantially conical section.

3. The turbomachine according to claim 1, wherein said flow path formed by said cylinder discharges said working fluid in a substantially axial direction.

4. The turbomachine according to claim 3, wherein:

a) said flow path formed by said exhaust conduit discharges said working fluid in a direction substantially perpendicular to the axial direction through an exhaust conduit outlet; and b) said exhaust diffuser has means for turning the direction of flow of said working fluid approximately 90°, said predetermined location on said periphery of said outer flow guide being oriented approximately 180° from said exhaust conduit outlet.

5. The turbomachine according to claim 3, wherein:

a) said flow path formed by said exhaust conduit discharges said working fluid in a direction substantially perpendicular to the axial direction through an exhaust conduit outlet;

b) said exhaust diffuser has means for turning the direction of flow of said working fluid approximately 90°; and c) said outer flow guide has an inlet lying in a plane substantially perpendicular to the axial direction and an outlet lying in a plane disposed at an acute angle to a plane perpendicular to said axial direction.

6. The turbomachine according to claim 5, wherein said angle is approximately 3°.

7. The turbomachine according to claim 5, wherein said outer flow guide has an inlet and an inner surface extending between said inlet and said outlet for directing said working fluid, a portion of said inner surface adjacent said inlet being substantially axially oriented and a portion of said inner surface adjacent said outlet being substantially radially oriented.

8. The turbomachine according to claim 3, wherein said exhaust conduit comprises:

a) a center portion and a periphery;

b) an inlet formed in said center portion, said outer flow guide outlet disposed in said exhaust conduit inlet; and c) an outlet formed in only a portion of said periphery;

whereby a first portion of said outer flow guide outlet is proximate said exhaust conduit outlet and a second portion of said outer flow guide outlet is remote from said exhaust conduit outlet.

9. The turbomachine according to claim 8, wherein said axial length of said outer flow guide is at a maximum value at said first portion and a minimum value at said second portion.

10. The turbomachine according to claim 8, wherein said turbomachine has a row of blades adapted to impart swirl to said working fluid, and wherein said axial length of said outer flow guide is at a minimum value at a location displaced circumferentially from said first portion of said outer flow guide by a first angle.

11. The turbomachine according to claim 9, wherein said axial length varies continuously between said minimum and maximum values.

12. The turbomachine according to claim 8, wherein said exhaust conduit has means for turning a portion of said working fluid discharging from said outer flow guide outlet at said second portion approximately 180°, thereby forming a vortex in said exhaust conduit.

13. A turbomachine comprising:

a) a turbine cylinder forming a flow path for directing a working fluid in an axial direction;

b) an exhaust conduit forming at least a portion of a substantially horseshoe-shaped chamber having an apex, said chamber having an outlet formed opposite said apex for directing said working fluid away from said turbine cylinder in a direction perpendicular to the axial direction after turning at least a portion of said working fluid approximately 180°, whereby a vortex is formed by said working fluid in said chamber that extends at least partially thereabout, a substantially radially extending baffle disposed in said chamber at said apex; and c) an exhaust diffuser having (i) an inlet for receiving said working fluid from said cylinder, (ii) an outlet for directing said working fluid to said exhaust conduit, and (iii) means for axially displacing said vortex toward said baffle, thereby minimizing the strength of said vortex.

14. The turbomachine according to claim 13, wherein said exhaust diffuser has inner and outer flow guides, said outer flow guide forming at least a portion of an inner boundary of said chamber, and wherein said vortex displacing means comprises the axial length of said outer flow guide varying around its periphery so as to be at a minimum value proximate said chamber apex and at a maximum value proximate said chamber outlet.

15. The turbomachine according to claim 14, wherein said flow guide has a longitudinal cross-section formed by first and second arcuate portions connected by a substantially conical portion.

16. The turbomachine according to claim 15, further comprising a row of rotating blades, each of said blades having an airfoil portion having a predetermined length, and wherein the ratios of the radii of curvature of said first and second flow guide arcuate portions to said blade airfoil length are in the range of approximately 0.25 to 0.4.

17. The turbomachine according to claim 15, wherein the radii of curvature of said first and second flow guide portions is substantially constant around the circumference of said outer flow guide.

18. In a steam turbine having (i) a turbine cylinder forming a flow path for directing steam in an axial direction, (ii) an exhaust diffuser having an inlet connected to said turbine cylinder and adapted to receive an axial flow of said steam and an outlet adapted to discharge said steam radially in a 360° arc, (iii) an exhaust housing enclosing said diffuser outlet so as to receive said 360° arc of steam and having an exhaust housing outlet for directing said steam away from said diffuser in a vertical direction, an outer flow guide for said diffuser comprising an approximately frusto-conical member having:

a) an approximately circular inlet lying in a plane oriented substantially perpendicular to the axial direction;

b) an approximately circular outlet having a first portion that is the portion of said outer flow guide outlet that is closest to said exhaust housing outlet and a second portion that is the portion of said outer flow guide outlet that is farthest from said exhaust housing outlet, said outer flow guide outlet lying in a plane oriented at an angle to a plane perpendicular to the axial direction so that the axial length of said outlet flow guide is at a minimum value at said second portion of said outlet and at a maximum value at said first portion of said outlet; and c) an inner surface adjacent to and upstream of said outlet, said inner surface having a smooth contour that deflects radially outward to as to be oriented substantially radially around its circumference at said outlet.

19. The outer flow guide according to claim 18, wherein said inlet is formed by a first arcuate section and said outlet is formed by a second arcuate section, and further comprising a conical section connecting said first and second sections.

* * * * *